United States Patent [19]

Johnson

[11] Patent Number: 4,705,987

[45] Date of Patent: Nov. 10, 1987

[54] VERY HIGH EFFICACY ELECTRODELESS HIGH INTENSITY DISCHARGE LAMPS

[75] Inventor: Peter D. Johnson, Schenectady, N.Y.

[73] Assignee: The United States of America as represented by the United States Department of Energy, Washington, D.C.

[21] Appl. No.: 783,730

[22] Filed: Oct. 3, 1985

[51] Int. Cl.[4] ..... H01J 61/20; H01J 61/30

[52] U.S. Cl. ..... 313/634; 313/639; 313/642; 313/161

[58] Field of Search ..... 313/161, 638, 639, 642, 313/493, 634

[56] References Cited

U.S. PATENT DOCUMENTS

| | | | |
|---|---|---|---|
| 2,114,885 | 4/1938 | Lowry | 250/27.5 |
| 2,330,600 | 9/1943 | Kuipers | 250/27.5 |
| 3,351,798 | 11/1967 | Bauer | 313/225 |
| 3,445,719 | 5/1969 | Thouret et al. | 315/49 |
| 3,763,392 | 10/1973 | Hollister | 315/248 |
| 3,860,854 | 1/1975 | Hollister | 315/248 |
| 3,958,145 | 5/1976 | Jack et al. | 313/184 |
| 3,979,624 | 9/1976 | Liu et al. | 313/229 |
| 4,135,110 | 1/1979 | Chalmers et al. | 313/225 |
| 4,310,774 | 1/1982 | Karlotski et al. | 313/228 |
| 4,422,011 | 12/1983 | Bruninx-Poesen et al. | 313/642 |
| 4,591,759 | 5/1986 | Chalek et al. | 313/161 X |

FOREIGN PATENT DOCUMENTS 1444023 7/1976 United Kingdom .

OTHER PUBLICATIONS

"Complex Halide Vapors in Metal Halide Type Hid Lamps", *Journal of IES*, p. 209, Jul. 1977.

"Electrodeless Hid Lamp Study", General Electric Co., Corporate Research and Development, (Lawrence Berkeley Lab.), Anderson et al., Jan. 1985.

*Primary Examiner*—David K. Moore

*Assistant Examiner*—K. Wieder

*Attorney, Agent, or Firm*—Clifton E. Clouse, Jr.; Roger S. Gaither; Judson R. Hightower

[57] ABSTRACT

An electrodeless arc lamp comprises an outer jacket hermetically sealing and thermally protecting an arc tube inside which has an upwardly convex bottom center section. The absence of chemically reactive electrode material makes it possible to use metal halides other than iodides. The tube contains chlorides, bromides or a mixture thereof of scandium and sodium in a nearly equimolar relationship in addition to mercury and an inert gas. Good color balance can be obtained at reduced reservoir temperature and with less power loss. Reduction in wall temperature makes it possible to attain longer lamp life.

8 Claims, 2 Drawing Figures

VERY HIGH EFFICACY ELECTRODELESS HIGH INTENSITY DISCHARGE LAMPS

The Government has rights in this invention pursuant to Contract No. DE-AC03-76SF00098 and Subcontract No. 4522010 awarded by the U.S. Department of Energy.

BACKGROUND OF THE INVENTION

This invention relates to high intensity discharge lamps and more particularly to a dose for electrodeless high intensity discharge devices containing sodium halide and scandium halide in predetermined proportions to enhance the device efficacy and to attain longer lamp life.

Since the invention of the high pressure mercury lamp, there has been a large effort to maximize the visible radiation from the plasmas in high intensity discharge lamps. Two of the major problems encountered in this effort have been the production of radiation outside the visible part of the spectrum and the loss of energy from the arc tube itself as infrared radiation because the arc tube must be hot enough to vaporize radiating atoms or it becomes heated unavoidably by the hot plasma. With high pressure sodium lamps, there is practically no energy wasted by radiative output in the ultraviolet, but the plasma still radiates significant amounts of power in the infrared, and nearly half of the input energy is lost as infrared incandescence of the very hot alumina arc tube.

A large variety of so-called mercury-metal halide arc discharge lamps have been investigated. British Patent Specification No. 1,444,023 discloses high pressure electrical discharges in a gas atmosphere containing aluminum halide, sodium chloride or iodide, mecury and a rare gas. U.S. Pat. No. 4,422,011 discloses high-pressure mercury vapor discharge lamps containing a rare gas, mercury, sodium halide such as sodium iodide and at least one halide of rare earth metals Ce, Pr, Nd and Lu. Sodium iodide in these lamps is intended to provide sodium atoms in the plasma as one of the principal radiators. In order to attain sodium iodide vapor pressures of several torr required to produce sodium radiation in the arc, the minimum arc tube wall temperature must be 750° C., and this means that nearly one-half of the input power in these lamps is again lost as infrared incandescence of the arc tube.

Scandium iodide is often added to sodium iodide in these arcs to enhance the color rendering qualities and efficacy. Sodium and scandium halides are known to form complexes $NaScX_4$ which have higher vapor pressure than the corresponding sodium halide NaX alone. C. Hirayama, et al. (Journal of IES, page 209, July, 1977), studying in particular the complex compound $NaI\text{-}ScI_3$, discussed that in commercial lamps where the $NaI/ScI_3$ ratio ranges from 15–30, the scandium vaporizes predominantly as the $NaScI_4$ complex and that since this ratio is high, there also is a significant contribution to the vapor from the sodium iodide. Although at low $NaI/ScI_3$ ratios the vaporization of both the sodium and scandium is dominated by the complex with the consequence that the vapor concentration of both radiators is greatly enhanced, the sodium vapor pressure enhancement is negligible in the typical range of the $NaI/ScI_3$ ratio in commercial lamps, and wall temperature must still be maintained relatively high.

In U.S. Pat. No. 3,979,624, bromides as well as iodides and mixtures of bromides and iodides were considered. In the presence of electrodes made of a chemically reactive material such as tungston, however, iodides are more frequently used.

SUMMARY OF THE INVENTION

It is an object of this invention to provide a high efficacy electrodeless high intensity discharge lamp in which the radiating species emit principally in the visible part of the spectrum with very little output in the ultraviolet or infrared.

It is another object of this invention to provide a discharge tube which requires reduced arc tube temperature for providing adequate vapor pressure of the radiating species so that useless power loss by the arc tube will be minimized.

It is a further object of this invention to provide a high efficacy arc lamp with very long useful life by using dopants which are chemically compatible with the arc tube material and by operation at lowered arc tube temperature so as to retard deleterious chemical processes.

Briefly, the electrodeless arc lamp of this invention may comprise a tube and a plasma-forming gas sealed therein. The plasma-forming gas may include an inert gas, mercury, scandium halide and sodium halide wherein these halides are chlorides, bromides or mixtures thereof.

Additional objects, advantages and novel features of the present invention will be set forth in part in the description which follows, and in part will become apparent to those skilled in the art upon examination of the following, or may be learned by practice of the invention. The objects, features and advantages of the invention may be realized and attained by means of the insrumentalities and combinations particularly pointed out in the appended claims.

DETAILED DESCRIPTION OF THE INVENTION

Reference will now be made in detail to preferred embodiments of the invention, and example of which is illustrated in the accompanying drawings. While the invention will be described in conjunction with the preferred embodiments, it will be understood that it is not intended to limit the invention to that embodiment. On the contrary, it is intended to cover all alternatives, modifications and equivalents as may be included within the spirit and scope of the invention as defined by the appended claims.

Figure 1:
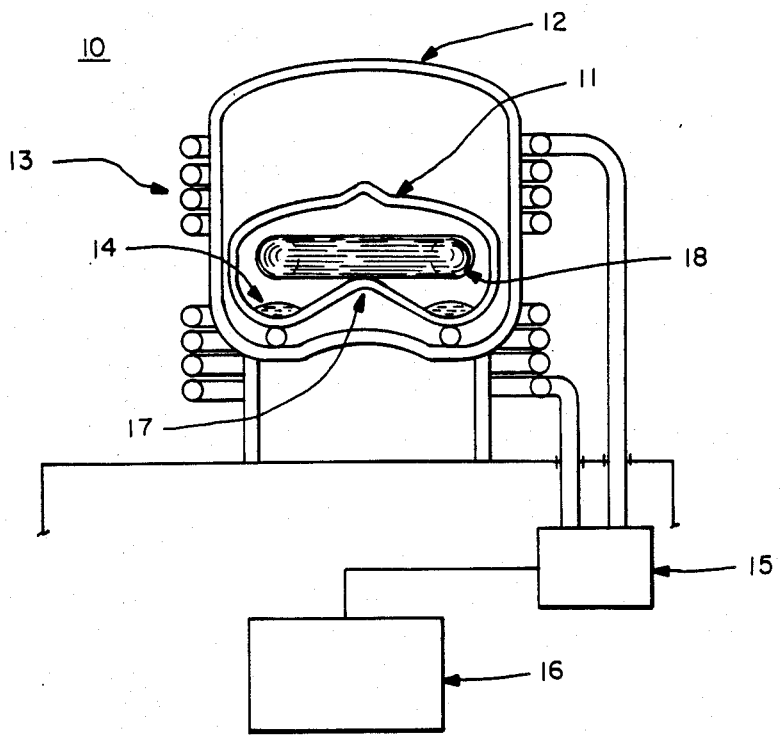
FIG. 1 is a schematic vertical cross-sectional view of a lamp embodying the present invention.

Referring now to the drawings, FIG. 1 depicts a vertical cross-sectional view of an electrodeless high intensity discharge lamp 10 according to an embodiment of the present invention. An evacuated, hermetically sealed arc tube 11 is shielded by an outer jacket 12 which is optically transparent and protects the tube 11 from cooling from convection, providing thermal isolation from the water-cooled radio frequency (rf) excitation coils 13. The center part 17 of the bottom of the arc tube 11 is raised and convex in the upward direction so that a molten halide reservoir 14 will reside near the arc 18. The excitation coils 13 are connected to an rf power supply 16 through an impedance matching network 15 in a manner well known in the art. According to one embodiment of the invention, the arc tube 11 has an average inside diameter of 4.8 cm, height of 1.4 cm and volume of 25 $cm^3$. During operation, the arc 18 is a ring with major or outer diameter of 3.8 cm and cross sectional diameter about 0.6 cm. Since there is no wall cooling on the side of the arc towards the center of the arc tube, considerable excitation of the radiative species residing towards the center of the arc tube occurs. The arc tube ingredients are 35 mg scandium chloride, 15 mg sodium chloride, 40 mg mercury and 10 torr argon. The arc is operated at power levels between 400 and 1100 W, at an rf frequency of 13.56 MHz. The arc 18 is the secondary of an air core transformer with the water-cooled copper coil 13 as the primary.

Figure 2:
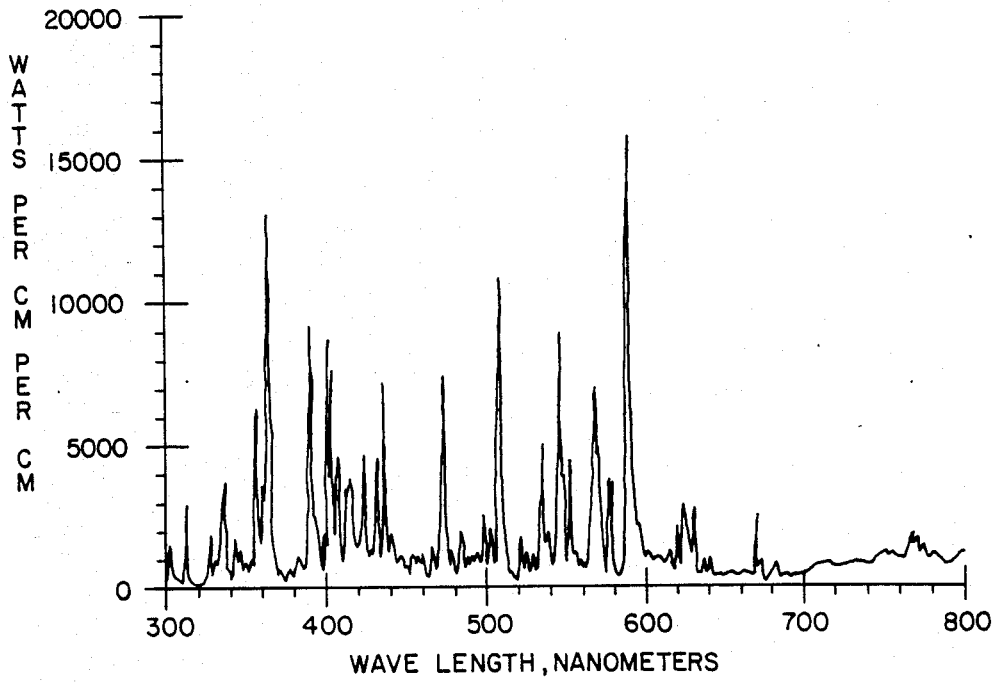
FIG. 2 is a graph which illustrates resulting spectral measurements obtained by using an arc tube according to one embodiment of the present invention.

FIG. 2 is a graph which illustrates resulting spectral measurements obtained by using an arc tube lamp similar to the one described above. The vertical coordinate represents the output power density and the horizontal coordinate represents the wave length in units of nanometers. The arc tube used to construct this lamp was of the shape of a hockey puck with a height of 2.4 cm, external diameter of 5.5 cm and wall thickness of about 0.15 cm. The arc tube contained 50 mg of mercury, 50 mg of sodium chloride, 50 mg of scandium chloride and 6 torr of argon at room temperature. The lamp was operated at 13.56 MHz with an arc voltage of 16 V/cm and an arc current of 4 amps. The lamp produced 95 lumens per watt.

The embodiments described above are intended to be interpreted as illustrative, not as limiting the scope of the present invention. As mentioned before, the electrodeless high intensity discharge lamp of the present invention can use metal chlorides and bromides in place of the usual iodides to provide the radiating species because there are no chemically reactive materials present. In this invention, scandium chloride, scandium bromide or a mixture thereof is used to supply scandium metal atoms in the hot plasma which radiate almost exclusively in the visible region of the optical spectrum. These halides have the advantage over scandium iodide in that they are chemically more stable in contact with fused silica. Accordingly, they slow down the reactions which reduce lamp life and hasten lumen depreciation in conventional lamps. Moreover, they are not deliquescent in contact with moist air as is scandium iodide. Thus, they have the effect of reducing the problem of contamination of the arc tube by water and simplify lamp manufacturing procedures.

Although scandium has spectral lines in all parts of the visible spectrum, it is desirable in order to have a good color balance to add radiation in the neighborhood of 590 nm. This is accomplished by sodium halide NaX which, when dissociated in the plasma, yields radiation in the neighborhood of the sodium D-lines. If an approximately equimolar amount of sodium halide is added to scandium halide $ScX_3$, a complex $NaScX_4$ is formed, which has four to five times the vapor pressure as NaX at the same reservoir temperature. Correspondingly, the same sodium vapor density can be attained with the complex at a reservoir temperature about 100° C. lower than when pure sodium halide or sodium halide with a small addition of scandium halide is used. This lower temperature results in less power loss from the arc tube wall and longer lamp life. If the requirement for the sodium radiation contribution to the output can be reduced, then further reduction in wall temperature with consequent higher efficacy and longer lamp life is attained. It will occur to those skilled in the art that fine balancing of the requirements of color and efficacy can be accomplished by the addition of still other metal halides. Generally, color can be improved in this way at the expense of loss of efficacy.

According to the present invention, X above is either Cl or Br, or is a mixture thereof. The preferred mole ratio $NaX/ScX_3$ covers the range of 0 to 4. A particular advantage of introducing chlorides of sodium and scandium is that chlorine molecules may be found in certain temperature regions of the arc as a result of dissociation of scandium chloride. The principal electronic transition of this molecule is the $X^1\Sigma_g^+ \rightarrow A^3\pi_0 + u$ transition with its peak output at 546 nm and extending mostly to the red side of the peak. Thus, the chlorine molecule can contribute efficiently to the radiative output of the plasma.

In addition to the ingredients described above, it may be desirable to add up to 10 mg of mercury per cubic centimeter of arc lamp volume, or in amounts giving up to 5 atmospheres in order to adjust the arc voltage to a desired value and to collision-broaden the lines of scandium and sodium and the bands of chlorine. For starting, an inert gas, preferably argon, in the pressure range of 1–100 torr, or preferably 2–25 torr, should be introduced into the arc tube.

Since all of the desired transitions of $Cl_2$, Na and Sc are resonance or near-resonance transitions, the plasma temperature will stay at a low value, in the neighborhood of 4000° K. Therefore, no excitation of, or energy loss by, the mercury and inert buffer gases will occur. The infrared from the higher excited states of sodium will also be suppressed. Adjustment of color and efficacy to the optimum values is accomplished by control of the relative amounts of Sc, Na and $Cl_2$ radiation. This is done by controlling the Na mole fraction in the dose from 0 to 80% and by controlling the reservoir temperature during lamp operation. The radial distribution of plasma temperature in the arc tube as determined by the input power will also affect the color and efficacy.

The foregoing description of the preferred embodiment of the invention is presented for purposes of illustration and description. It is not intended to be exhaustive or to limit the invention to the precise form disclosed, and obviously many modifications and variations are possible in light of the above teaching. The embodiment was chosen and described in order to best explain the principles of the invention and its practical application to thereby enable others skilled in the art to best utilize the invention and various embodiments and with various modifications as are suited to the particular use contemplated. It is intended that the scope of the invention be defined only by the claims appended hereto.

What is claimed is:

1. An electrodeless arc lamp for forming a ring shaped plasma in a region therein during operation comprising a tube having a raised bottom center section, and an optically transparent outer jacket hermetically sealing said tube to protect said tube from cooling by convection, said raised center section rising centrally to form a ring shaped reservoir below the region in which the ring shaped plasma is formed to minimize wall cooling during operation of the lamp so that there is enhanced excitation near the center of the tube.

2. The electrodeless arc lamp of claim 1 wherein said tube contains an inert gas, mercury, scandium halide and sodium halide, at least a portion of said halides being in a molten state in said reservoir and conforming to the ring shape of the reservoir.

3. The electrodeless arc lamp of claim 2 wherein said halides are selected from a group consisting of chlorides, bromides and mixtures of chlorides and bromides.

4. The electrodeless arc lamp of claim 1 comprising a plasma-forming gas sealed inside said tube, said plasma-forming gas including an inert gas, mercury, scandium halide and sodium halide, said halides being selected from a group consisting of chlorides, bromides and mixtures of chlorides and bromides, and wherein said plasma-forming gas has a sodium to scandium mole ratio equal to or smaller than 4.

5. The electrodeless arc lamp of claim 1 wherein said halides are chlorides.

6. The electrodeless arc lamp of claim 1 wherein said inert gas is argon at a pressure of 1–100 torr.

7. The electrodeless arc lamp of claim 1 wherein said inert gas is at a pressure of 2–25 torr.

8. The electrodeless arc lamp of claim 1 wherein said tube contains 10 mg or less of mercury per cubic centimeter of the volume of said tube.

* * * * *